US005977841A

United States Patent [19]

Lee et al.

[11] Patent Number: 5,977,841

[45] Date of Patent: Nov. 2, 1999

[54] NONCONTACT RF CONNECTOR

[75] Inventors: J. J. Lee, Irvine; Donald Charlton, Huntington Beach; William L. Lange, Placentia, all of Calif.

[73] Assignee: Raytheon Company, Lexington, Mass.

[21] Appl. No.: 08/771,075

[22] Filed: Dec. 20, 1996

[51] Int. Cl.[6] ..... H01P 1/04

[52] U.S. Cl. ..... 333/24 C; 333/260; 343/713; 343/862; 439/950

[58] Field of Search ..... 439/950, 578; 333/24 C, 34, 35, 260; 343/713, 715, 862

[56] References Cited

U.S. PATENT DOCUMENTS

| | | | |
|---|---|---|---|
| 2,518,665 | 8/1950 | Collard | 333/260 X |
| 3,089,105 | 5/1963 | Alford | 333/260 X |
| 5,075,645 | 12/1991 | Eda et al. | 333/34 |
| 5,557,290 | 9/1996 | Watanabe | 343/713 |

*Primary Examiner*—Paul Gensler
*Attorney, Agent, or Firm*—Leonard A. Alkov; Glenn H. Lenzen, Jr.

[57] ABSTRACT

An RF connector comprising a coaxial transmission structure that transmits RF power at RF and microwave frequencies through a dielectric seal. Portions of the connector on either side of the seal do not make metal to metal contact. The connector has input and output connector portions having outer conductors coaxially disposed around inner conductors with dielectric material disposed therebetween. Impedance matching transition portions abut each side of the dielectric seal that have a relatively large diameter adjacent the dielectric seal that transitions to a relatively small diameter distal from the dielectric seal. Tapered and stepped impedance matching transition portions may be employed. A shunt capacitance is disposed approximately one quarter wavelength from each side of the dielectric seal in the stepped transition version. RF energy transmitted by way of the input connector portion is capacitively coupled through the dielectric seal to the output connector portion.

8 Claims, 3 Drawing Sheets

NONCONTACT RF CONNECTOR

GOVERNMENT RIGHTS

This invention was developed under Contract No. N66604-96-C-A047 awarded by the Department of the Navy. The U.S. Government has certain rights in this invention.

BACKGROUND

The present invention relates generally to noncontact RF connectors, and more particularly, to a noncontact RF connector that transmits RF power through a dielectric seal without a metal to metal contact.

Noncontact connectors are used in applications where metallic corrosion or marine growth is a critical problem. This type of situation is experienced in a harsh environment such as salt water, for example, and particularly in applications involving submarines, and the like. For low frequency applications, such as at frequencies below 100 MHz, noncontact connectors using inductive and capacitive coupling have heretofore been used. However, at higher RF and microwave frequencies, the performance of conventional inductive and capacitive noncontact connectors is not acceptable, manifested by high reflections and leakage.

Accordingly, it is an objective of the present invention to provide for an improved noncontact RF connector that transmits RF power at RF and microwave frequencies through a dielectric seal without requiring metal to metal contact. It is a further objective of the present invention to provide for a noncontact RF connector whose design is based on a TEM radial field distribution in the connector.

SUMMARY OF THE INVENTION

To meet the above and other objectives, the present invention provides for an improved noncontact RF coaxial connector that transmits RF power at RF and micro-wave frequencies through a dielectric seal without requiring metal to metal contact. The noncontact RF connector is a coaxial transmission structure that transmits RF power through the dielectric seal. Portions of the connector on either side of the seal do not make metal to metal contact. Therefore, there is no corrosion buildup at the junction between the respective portions of the connector when it is used in underwater applications. The noncontact RF connector has a coaxial design that is based on a TEM radial field distribution. The noncontact RF connector has been designed to provide a wide bandwidth impedance match.

The connector has an input connector portion comprising an outer conductor coaxially disposed around an inner conductor with dielectric material disposed between the inner and outer conductors. An impedance matching transition portion abuts an input side of the dielectric seal that has a relatively large diameter adjacent the dielectric seal and transitions to a relatively small diameter distal from the dielectric seal. The connector also has an output connector portion comprising an outer conductor coaxially disposed around an inner conductor with dielectric material disposed between the inner and outer conductors. An impedance matching transition portion abuts an output side of the dielectric seal that has a relatively large diameter adjacent the dielectric seal and transitions to a relatively small diameter distal from the dielectric seal. RF energy transmitted by way of the input connector portion is capacitively coupled through the dielectric seal to the output connector portion. The RF connector operates by capacitively coupling both the inner and outer conductors through the dielectric seal.

One embodiment of the noncontact RF coaxial connector may have a smooth transition wherein the impedance matching transition portions are smoothly tapered. Another embodiment of the noncontact RF coaxial connector may have impedance matching transition portions that are stepped. In this case, good impedance matching is accomplished by adding a shunt capacitance to the coaxial line approximately one quarter wavelength from the junction at each side of the dielectric seal. The use of the shunt capacitance eliminates reflections that would otherwise be generated by the connector. For commonality, the coaxial line may transition to a size that is compatible with a standard 50 ohm SMA connector, for example.

The dielectric material disposed between the inner and outer conductors of the noncontact RF connector may preferably be a dielectric material such as Teflon having a dielectric constant of about 2.1, for example. For some applications, the thickness of the dielectric seal between the connectors may be increased and a dielectric material having a higher dielectric constant may be used.

The noncontact RF coaxial connector may be used in a wide range of applications where metallic corrosion or marine growth problems are experienced, such as in a harsh environment involving salt water, for example. In particular, the development of the present noncontact RF coaxial connector was motivated by the need for a noncontact waterproof connector for a submarine array antenna developed by the assignee of the present invention.

This noncontact RF coaxial connector does not experience corrosion problems encountered using previously used connectors. In addition, the noncontact RF coaxial connector may be used to simplify the feed design for a phased array, for example, where numerous interconnects for input and output signals are involved. The design of the noncontact RF coaxial connector relieves the concern for pin alignment, contact resistance, and wear and tear, and the like, encountered in many applications where blind connection between electronic modules is necessary.

The noncontact RF coaxial connector may be used with RF and microwave systems where coaxial connectors are required, such as in military and commercial applications. In particular, phased antenna arrays having a large number of transmit and receive (T/R) modules may benefit from the present invention, along with electric vehicle and television signal transmission applications, for example. The present invention may be used to replace existing noncontact connectors based on inductive or capacitive coupling used in lower frequency applications, for example.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 2:
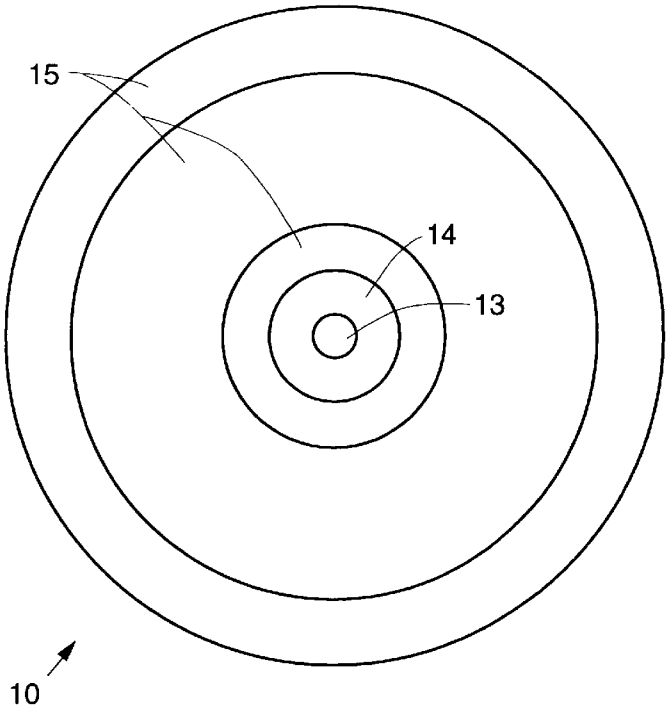
FIG. 2 illustrates an end view of the connector of FIG. 1 in the direction of the lines 2—2.
Figure 1:
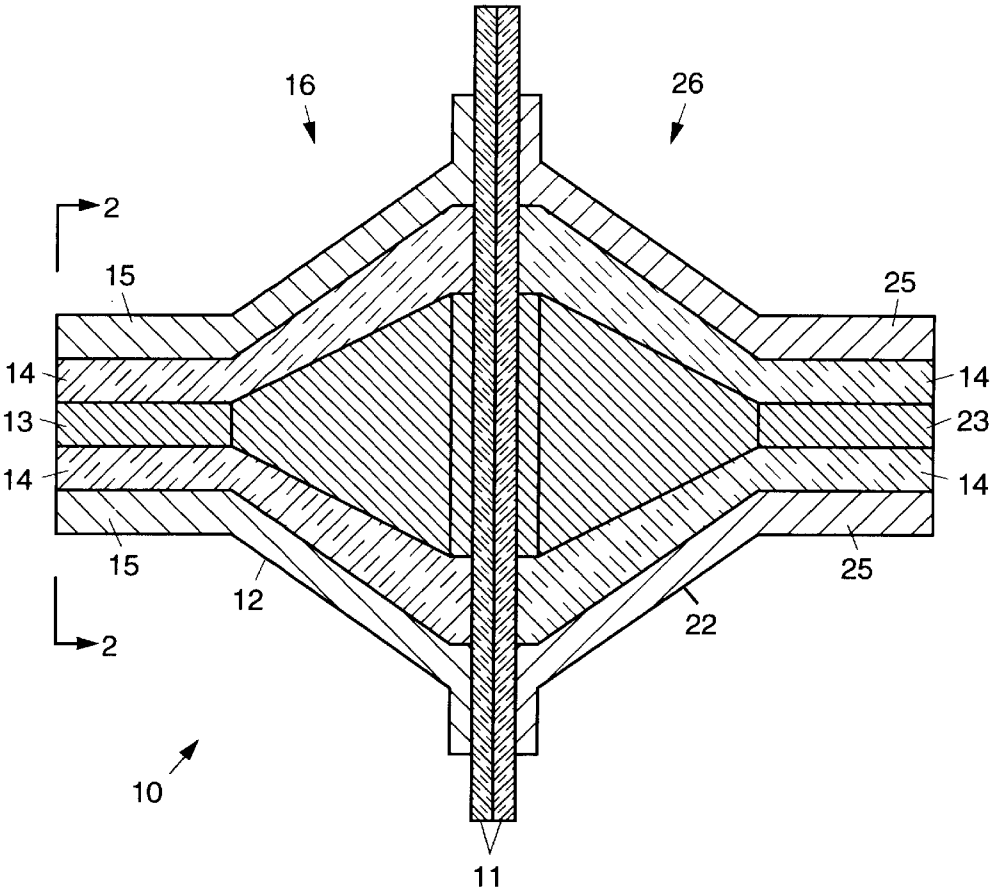
FIG. 1 illustrates a cross sectional view of a first embodiment of a coaxial noncontact RF connector in accordance with the principles of the present invention.

Referring to the drawing figures, FIG. 1 illustrates a cross sectional view of a first embodiment of a coaxial noncontact RF connector 10 in accordance with the principles of the present invention. FIG. 2 illustrates an end view of the connector 10 of FIG. 1. The design of the coaxial noncontact RF connector 10 shown in FIGS. 1 and 2 is based on a TEM radial field distribution that provides a wide band impedance match. The coaxial noncontact RF connector 10 transmits RF power through a dielectric seal 11, such as a glass window in a submarine, or other underwater vehicle, for example.

Referring to FIGS. 1 and 2, the noncontact RF connector 10 has an input connector portion 12 comprising an outer conductor 15 coaxially disposed around an inner conductor 13. Dielectric material 14 is disposed between the inner and outer conductors 13, 15. An impedance matching input transition portion 16 abuts an input side of the dielectric seal 11, and is tapered in the embodiment of FIG. 1. The impedance matching input transition portion 16 has a relatively large diameter adjacent the dielectric seal 11 and transitions to a relatively small diameter distal from the dielectric seal 11.

The noncontact RF connector 10 has an output connector portion 22 comprising an outer conductor 25 coaxially disposed around an inner conductor 23. Dielectric material 14 is disposed between the inner and outer conductors 23, 25. An impedance matching output transition portion 26 that is also tapered abuts an output side of the dielectric seal 11 that has a relatively large diameter adjacent the dielectric seal 11 and transitions to a relatively small diameter distal from the dielectric seal 11.

The dielectric material 14 used in the respective input and output connector portions 12, 22 may comprise Teflon or other dielectric material 14. In a reduced to practice embodiment of the connector 10, a dielectric material 14 having a dielectric constant of 2.1 was used.

Figure 3:
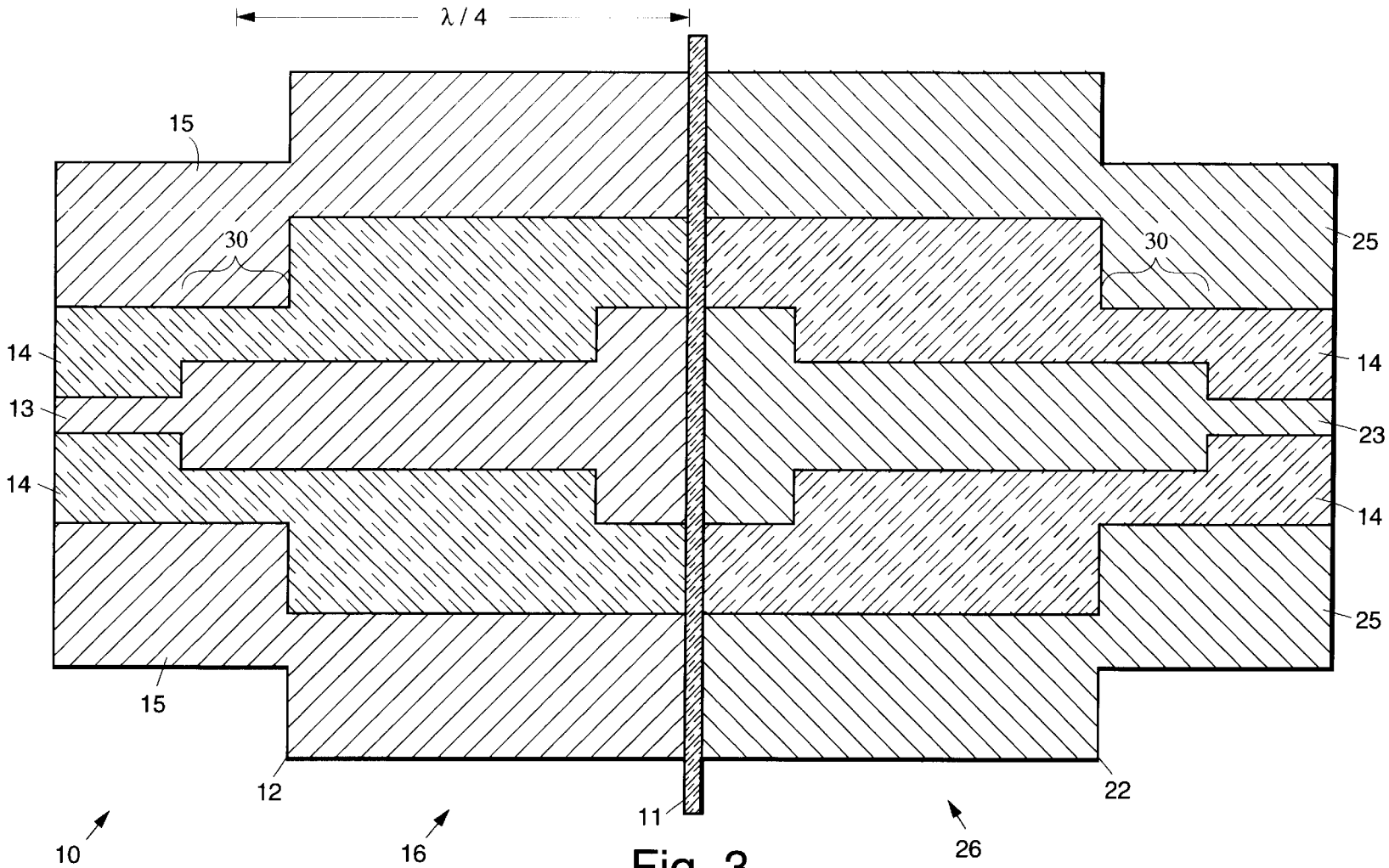
FIG. 3 illustrates a cross sectional view of a second embodiment of a coaxial noncontact RF connector in accordance with the principles of the present invention.

FIG. 3 illustrates a cross sectional view of a second embodiment of the present coaxial noncontact RF connector 10. The second embodiment of the connector 10 has a stepped configuration. The inner and outer conductors 13, 15, 23, 25 of the input and output connector portions 12, 22 and the dielectric material 14 disposed between the respective pairs of conductors 13, 15, 23, 25 are each stepped from a large diameter adjacent the dielectric seal 11 to a relatively small diameter at respective ends of the connector 10. The shunt capacitance 30 is formed in each of the respective input and output connector portions 12, 22. In the embodiment of FIG. 3 the shunt capacitance 30 is comprised of Teflon dielectric material.

The noncontact coaxial RF connector 10 operates by capacitively coupling RF energy from the inner and outer pairs of conductors 13, 15, 23, 25 through the dielectric seal 11. As such, the design of the impedance-matching structure depends heavily on the capacitance of the junction between the dielectric seal 11 and the respective inner and outer pairs of conductors 13, 15, 23, 25 and the dielectric material 14 disposed therebetween. Impedance matching is accomplished by adding the shunt capacitance 30 to the coaxial line approximately one quarter wavelength from each side the junction at the dielectric seal 11. The use of the shunt capacitance 30 eliminates reflections that would otherwise be generated by the connector 10. For commonality, the coaxial line is transformed to a size compatible with a standard 50 ohm SMA connector, for example.

Impedance matching in the connector 10 shown in FIG. 3 was achieved by first characterizing the junction and several coaxial shunt capacitors 30 using an electromagnetic simulation program known as Eminence (available from Ansoft Corporation, Pittsburgh, Pa.), which generated s-parameter data. The s-parameter data computed by the Eminence program was then imported into a circuit optimization program known as Libra (available from Hewlett-Packard Company, Palo Alto, Calif.). Finally, the Libra program was used to select the best coaxial capacitor 30 and optimize transmission line lengths. For verification, the performance of the optimized geometry of the connector 10 was characterized again using the Eminence program for a final check before fabricating the connector 10.

Figure 4:
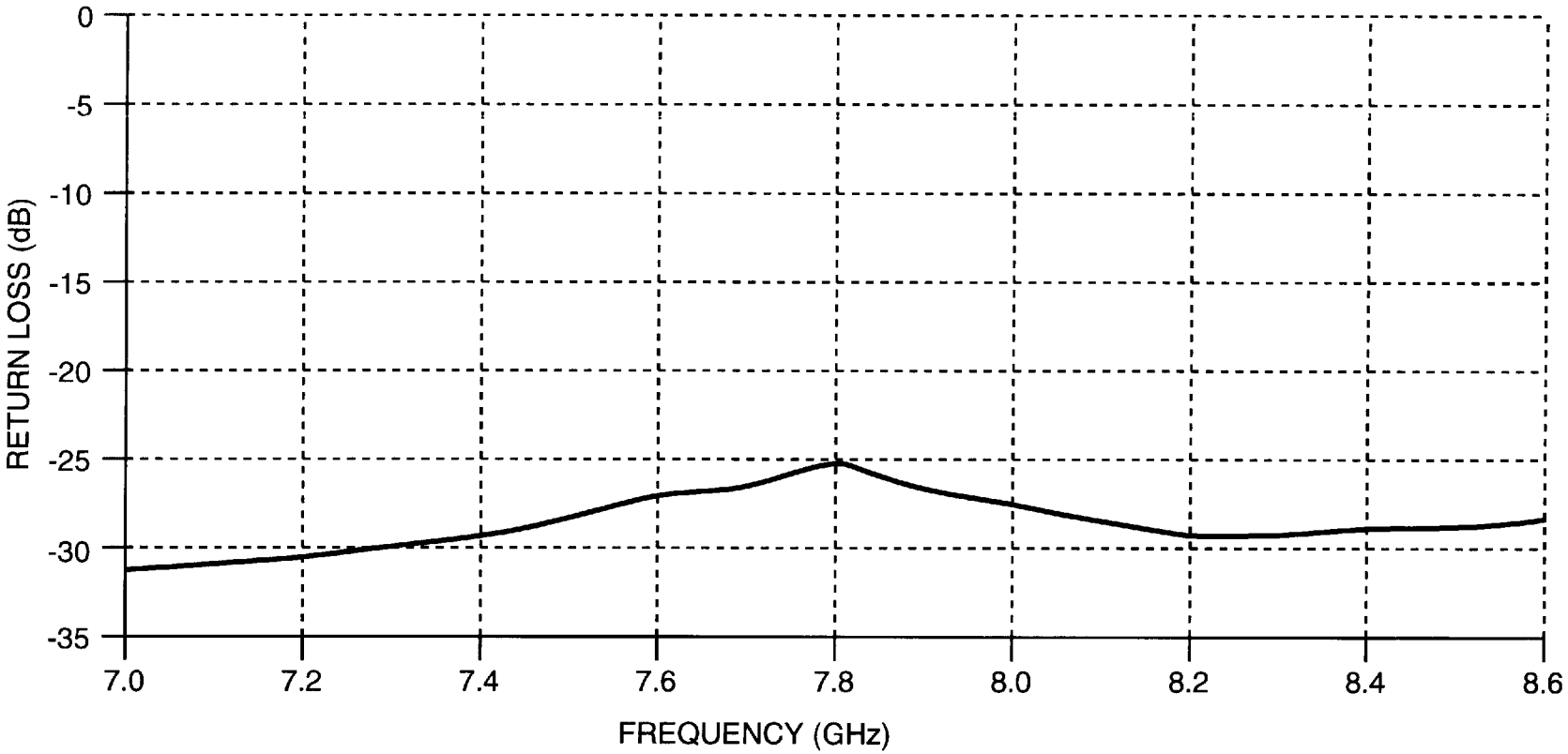
FIG. 4 is a graph that illustrates the performance achieved by the connector of FIG. 3.

The coaxial noncontact RF connector 10 shown in FIG. 3 was reduced to practice and tested. The design of the noncontact coaxial RF connector 10 is based on TEM radial field distribution which provides for a wide bandwidth impedance match. For low cost and ease of construction, a two-step transition is chosen for illustration as a practical example, and which is shown in FIG. 3. The RF performance of the connector 10 of FIG. 3 is illustrated in FIG. 4, which shows the return loss of the connector 10 over an SHF band from 7 to 8.6 GHz. The insertion loss of the connector 10 is less than 0.2 dB over the same frequency band.

The reduced to practice connector 10 has the following dimensions. The largest diameter of connector portions 12, 22 have outside diameters of 0.400 inches. The dielectric material 14 has a 0.222 inch large diameter. The dielectric material 14 has a 0.121 inch small diameter. A 0.212 inch length of dielectric material 14 is disposed adjacent to the dielectric seal 11 and the shunt capacitance 30 is 0.099 inches long. The inner conductors 13, 23 have diameters of 0.120 inches, 0.066 inches, and 0.036 inches. The dielectric seal 11 has a thickness of 0.010 inches.

The dielectric material 14 between the inner and outer conductors may preferably be Teflon with a dielectric constant of 2.1. For some applications, the thickness of the dielectric seal 11 between the connector portions 12, 22, which may be a 10 mil gap in the embodiment of the connector 10 shown in FIG. 3, may be increased and a dielectric material 14 may be used that has a dielectric constant that is higher than 2.1.

RF energy transmitted by way of the input connector portion 12 is capacitively coupled through the dielectric seal 11 to the output connector portion 22. The noncontact RF coaxial connector 10 transmits RF power through the dielectric seal 11 without requiring metal to metal contact between portions 12, 22 of the connector 10 that are disposed on opposite sides of the dielectric seal 11. Because the connector 10 does not make any metal to metal contact, there is no potential corrosion buildup at the junction for underwater applications. Good impedance matching is provided by adding the shunt capacitance 30 to the coaxial line approximately one quarter wavelength from each side of the dielectric seal 11. Opposite ends of the RF connector 10 (coaxial line) may be configured to be compatible with a standard 50 ohm SMA connector.

The noncontact RF coaxial connector 10 may be used in a wide range of applications where metallic corrosion or marine growth problems are experienced, such as in a harsh environment involving salt water, for example. In particular, the development of the present noncontact RF coaxial connector 10 was motivated by the need for a noncontact waterproof connector 10 for a submarine array antenna developed by the assignee of the present invention.

This noncontact RF coaxial connector 10 does not experience corrosion problems encountered using previously used connectors. In addition, the noncontact RF coaxial connector 10 may be used to simplify the feed design for a phased array, for example, where numerous interconnects for input and output signals are involved. The design of the noncontact RF coaxial connector 10 relieves the concern for pin alignment, contact resistance, and wear and tear, and the like, encountered in many applications where blind connection between electronic modules is necessary.

The noncontact RF coaxial connector 10 may be used with RF and microwave systems where coaxial connectors are required, such as in military and commercial applications. In particular, phased antenna arrays having a large number of transmit and receive (T/R) modules may benefit from the present invention, along with electric vehicle and television signal transmission applications, for example. The present invention may be used to replace existing noncontact connectors based on inductive or capacitive coupling used in lower frequency applications, for example. The noncontact RF coaxial connector 10 may be used in lieu of conventional inductive or capacitive coupler designs used for lower frequency applications, such as for power transfer in electric vehicles, or signal transmission for TV reception, for example.

Thus, a noncontact RF connector that transmits RF power through a dielectric seal without requiring metal to metal contact between portions of the connector on opposite sides of the seal has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An RF connector that transmits RF power through a dielectric seal, said connector comprising:

an input connector portion comprising an outer conductor coaxially disposed around an inner conductor, and having dielectric material disposed between the inner and outer conductors, and having an impedance matching input transition portion that abuts an input side of the dielectric seal that has a relatively large diameter adjacent the dielectric seal and transitions to a relatively small diameter distal from the dielectric seal; and an output connector portion comprising an outer conductor coaxially disposed around an inner conductor, and having dielectric material disposed between the inner and outer conductors, and having an impedance matching output transition portion that abuts an output side of the dielectric seal that has a relatively large diameter adjacent the dielectric seal and transitions to a relatively small diameter distal from the dielectric seal;

and wherein RF energy transmitted by way of the input connector portion is capacitively coupled through the dielectric seal to the output connector portion.

2. The connector of claim 1 wherein the impedance matching input and output transition portions of the input and output connector portions are tapered.

3. The connector of claim 1 wherein the impedance matching input and output transition portions of the input and output connector portions are stepped, and wherein the input and output connector portions each have a shunt capacitance disposed approximately one quarter wavelength from the dielectric seal.

4. The connector of claim 1 wherein the dielectric material disposed between the respective inner and outer conductors has a dielectric constant of 2.1.

5. An RF connector that transmits RF power through a dielectric sea, said connector comprising:

an input connector portion comprising an outer conductor coaxially disposed around an inner conductor, and having dielectric material disposed between the inner and outer conductors, and having a tapered impedance matching input transition portion that abuts an input side of the dielectric seal that has a relatively large diameter adjacent the dielectric seal and transitions to a relatively small diameter distal from the dielectric seal; and an output connector portion comprising an outer conductor coaxially disposed around an inner conductor, and having dielectric material disposed between the inner and outer conductors, and having a tapered impedance matching output transition portion that abuts an output side of the dielectric seal that has a relatively large diameter adjacent the dielectric seal and transitions to a relatively small diameter distal from the dielectric seal;

and wherein RF energy transmitted by way of the input connector portion is capacitively coupled through the dielectric seal to the output connector portion.

6. The connector of claim 5 wherein the dielectric material disposed between the respective inner and outer conductors has a dielectric constant of 2.1.

7. An RF connector that transmits RF power through a dielectric seal, said connector comprising:

an input connector portion comprising an outer conductor coaxially disposed around an inner conductor, and having dielectric material disposed between the inner and outer conductors, and having a stepped impedance matching input transition portion that abuts an input side of the dielectric seal that has a relatively large diameter adjacent the dielectric seal and transitions to a relatively small diameter distal from the dielectric seal, and having a shunt capacitance disposed approximately one quarter wavelength from the dielectric seal; and an output connector portion comprising an outer conductor coaxially disposed around an inner conductor, and having dielectric material disposed between the inner and outer conductors, and having a stepped impedance matching output transition portion that abuts an output side of the dielectric seal that has a relatively large diameter adjacent the dielectric seal and transitions to a relatively small diameter distal from the dielectric seal, and having a shunt capacitance disposed approximately one quarter wavelength from the dielectric environmental seal;

and wherein RF energy transmitted by way of the input connector portion is capacitively coupled through the dielectric seal to the output connector portion.

8. The connector of claim 7 wherein the dielectric material disposed between the respective inner and outer conductors has a dielectric constant of 2.1.

* * * * *